US008628904B2

(12) United States Patent
Iguchi et al.

(10) Patent No.: US 8,628,904 B2
(45) Date of Patent: Jan. 14, 2014

(54) CARRIER, DEVELOPER FOR REPLENISHMENT, DEVELOPER CARTRIDGE FOR REPLENISHMENT, AND IMAGE FORMING APPARATUS

(75) Inventors: Moegi Iguchi, Kanagawa (JP); Satoshi Inoue, Kanagawa (JP); Koutarou Yoshihara, Saitama (JP); Masahiro Takagi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 780 days.

(21) Appl. No.: 12/509,054

(22) Filed: Jul. 24, 2009

(65) Prior Publication Data

US 2010/0248109 A1 Sep. 30, 2010

(30) Foreign Application Priority Data

Mar. 26, 2009 (JP) ..... 2009-076989

(51) Int. Cl.
*G03G 9/00* (2006.01)

(52) U.S. Cl.
USPC ..... 430/111.35; 430/118.6; 430/137.11; 430/137.13; 430/111.3; 430/111.4

(58) Field of Classification Search
USPC ..... 430/111.35, 118.6, 137.11, 137.13, 430/111.3, 111.4
See application file for complete search history.

(56) References Cited

U.S. PATENT DOCUMENTS

| | | | | |
|---|---|---|---|---|
| 4,284,702 | A | 8/1981 | Tabuchi et al. | |
| 6,127,079 | A * | 10/2000 | Sumiyoshi et al. | 430/111.35 |
| 2002/0064724 | A1 * | 5/2002 | Nakamura et al. | 430/111.33 |
| 2006/0222982 | A1 * | 10/2006 | Fujikawa | 430/106.1 |
| 2008/0102396 | A1 * | 5/2008 | Fukushima et al. | 430/109.5 |
| 2009/0074450 | A1 | 3/2009 | Nagayama et al. | |

FOREIGN PATENT DOCUMENTS

| | | |
|---|---|---|
| JP | B2-59-24416 | 6/1984 |
| JP | B2-2-21591 | 5/1990 |
| JP | A-5-100493 | 4/1993 |
| JP | B2-8-3679 | 1/1996 |
| JP | A-2000-047435 | 2/2000 |
| JP | A-2004-333514 | 11/2004 |

OTHER PUBLICATIONS

Office Action dated Feb. 24, 2012 issued in Chinese Patent Application No. 200910166091.5 (with translation).

* cited by examiner

*Primary Examiner* — Mark F Huff
*Assistant Examiner* — Rachel Zhang
(74) *Attorney, Agent, or Firm* — Oliff and Berridge, PLC

(57) ABSTRACT

The present invention provides a carrier for replenishment including an associated particle in which single particles each having a core material and a resin layer covering the core material, are bound via the resin layer, the carrier being used in a developer for replenishment of a trickle development system, and the system including performing development while the developer for replenishment is replenished, upon development of a latent image on a latent image holding member using a development unit.

13 Claims, 4 Drawing Sheets

CARRIER, DEVELOPER FOR REPLENISHMENT, DEVELOPER CARTRIDGE FOR REPLENISHMENT, AND IMAGE FORMING APPARATUS

CROSS-REFERENCE TO RELATED APPLICATIONS

This application is based on and claims priority under 35 USC 119 from Japanese Patent Application No. 2009-076989 filed on Mar. 26, 2009.

BACKGROUND

1. Technical Field

The present invention relates to a carrier for replenishment, a developer for replenishment, a developer cartridge for replenishment, and an image forming apparatus.

2. Related Art

In recent years, an image forming apparatus such as a copying machine for forming an image utilizing electrophotography has been variously expanded in utility thereof, and is required to have higher image quality with wider spread. In order to respond to higher image quality, the diameter of a toner and a carrier used is being reduced.

SUMMARY

According to an aspect of the present invention, there is provided a carrier for replenishment comprising an associated particle in which single particles each having a core material and a resin layer covering the core material, are bound via the resin layer, the carrier being used in a developer for replenishment of a trickle development system, and the system comprising performing development while the developer for replenishment is replenished, upon development of a latent image on a latent image holding member using a development unit.

BRIEF DESCRIPTION OF THE DRAWINGS

Exemplary embodiments of the invention will be described in detail based on the following figures, wherein.

DETAILED DESCRIPTION

<Carrier for Replenishment>

Figure 1:
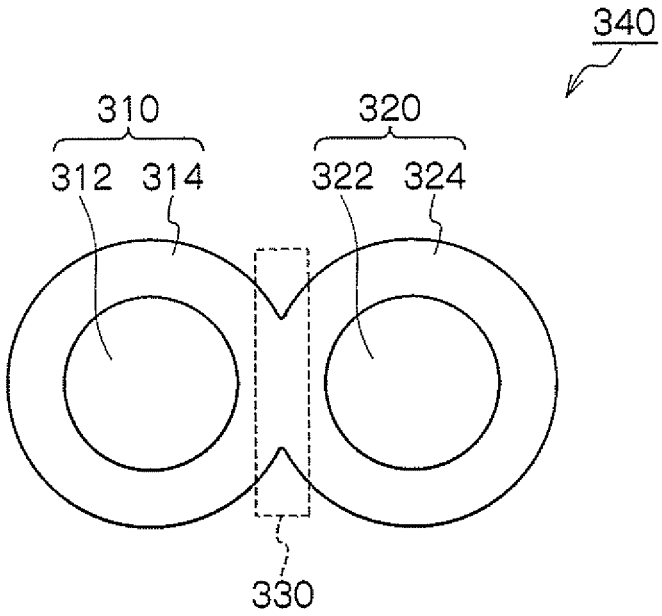
FIG. 1 is a schematic view showing an example of a cross-sectional structure of an associated particle of the present exemplary embodiment of the invention.

The carrier for replenishment of the present exemplary embodiment of the invention contains an associated particle in which single particles each having a core material and a resin layer covering the core material are bound via the resin layer, and is used in a developer for replenishment of a trickle development system including performing development while the developer for replenishment is replenished, upon development of a latent image on a latent image holding member using a development unit.

Currently, image formation of an electrophotography system is such that a toner is reduced in the particle diameter or is narrowed in the particle size distribution for higher image quality, and a carrier is reduced in the particle diameter for realizing a finer bristle of a developer brush on the developer holding member. Reduction in the diameter of the carrier is advantageous for higher image quality since a toner is charged without unevenness. However, on the other hand, reduction in the diameter of the carrier increases the specific surface area, and the carrier easily undergoes toner consumption, reduction in charging occurs, and it is difficult to obtain stable charging over a long period of time.

To the contrary, a trickle development system of replenishing a carrier with a toner consumed by development is proposed in Japanese Patent Application Publication (JP-B) No. 2-21591, but a toner easily takes closest packing structure in a toner replenishing apparatus, and densely aggregating property is easily increased. When densely aggregating property is increased in the toner replenishing apparatus, taking out property of the toner is reduced. In addition, when excessive dense aggregation occurs, the toner is taken out in the agglomerated state in some cases, and a low charged toner is generated. Further, depending on an image density of the toner, taking out property of the toner is easily fluctuated, and concentration fluctuation is generated with time. That is, when the toner image density is low, the stirring time in a developer cartridge for replenishment is decreased, and taking out property is reduced. On the other hand, when the toner image density is high, the stirring time in the developer cartridge for replenishment is increased, and taking out property becomes higher as compared with the low toner image density.

In addition, a replenishment kit including a mixture of spherical magnetic carrier particles greater than the weight average particle diameter of the toner is proposed in Japanese Patent Application Laid-Open (JP-A) No. 2004-333514, but in the spherical magnetic carrier particle greater than the weight average particle diameter of the toner, densely aggregating property is increased with time, and concentration fluctuation is generated in some cases. In addition, when the magnetic carrier particle is replenished in a development apparatus, upon formation of a developer brush on a developer holding member, a fine cluster is not attained, and a clear image is not obtained in some cases.

In the carrier for replenishment of the present exemplary embodiment of the invention, by inclusion of an associated particle in which single particles each having a core material and a resin layer covering the core material are bound via the resin layer, formation of a closest packing structure is prevented, and excessive dense aggregation is suppressed. As a result, concentration fluctuation over time is suppressed. This is thought to be due to (1) prevention of production of an aggregate and suppression of excessive dense aggregation due to the presence of an associated particle, and thus, suppression of dense aggregation and the associated particle's own weight, and (2) suppression of destabilization of a toner extraction property due to fluctuation of the toner image density.

As described below, since the associated particle is degraded by a stirring conveying member in a developer for replenishment and a developing apparatus (development unit) to become single particles upon formation of a developer brush on a developer holding member, and the particle diameter and the shape become equal to those of the carrier originally accommodated in the developing apparatus, a fine cluster is formed, concentration fluctuation per image is suppressed, and further, an image in which roughness of a surface is suppressed is obtained over a long period of time.

The carrier for replenishment of the present exemplary embodiment of the invention will be explained in detail below.

The associated particle is an indeterminate-shaped carrier particle in which two or more single particles are bound via the resin layer. This associated particle refers to a carrier particle in the state where a part of the resin layer of one single particle and a part of the resin layer of other single particle are bound or adhered to unify, and are connected. The associated particle is made by controlling preparation condition upon preparation of a single particle used in the carrier (specifically, production condition upon formation of a resin layer on a core material surface). Alternatively, the associated particle is also prepared by heat-treating a once prepared single particle to such the extent that fusion of resin layers occurs.

FIG. 1 is a schematic view showing an example of a cross-sectional structure of the associated particle of the present exemplary embodiment of the invention. As shown in FIG. 1, two single particles are bound via the resin layer to form an associated particle. Herein, reference numeral 310 represents a first single particle, 312 represents a core material, 314 represents a resin layer, 320 represents a second single particle, 322 represents a core material, 324 represents a resin layer, 330 represents a bound part, and 340 represents an associated particle.

The associated particle 340 shown in FIG. 1 has two single particles 310, 320, and a part of the resin layer 314 of the first single particle 310 having the core material 312 and the resin layer 314 covering this, and a part of the resin layer 324 of the second single particle 320 having the core material 322 and the resin layer 324 covering this are connected to form the bound part 330.

Whether the carrier particle is the associated particle or the single particle is easily determined depending on whether the bound part 330 is present in the carrier particle or not, upon observation of the carrier using a scanning electron microscope.

In an example shown in FIG. 1, the associated particle in which two single particles are bound is shown, but the number of single particles constituting the associated particle (hereinafter, referred to as "association number" in some cases) is not particularly limited as far as the number is 2 or more, and an upper limit thereof is preferably 15 or less, more preferably 10 or less. When the association number is more than 15, it becomes difficult to prepare this associated particle in some cases, and an image quality defect is easily generated in some cases.

The carrier for replenishment of the present exemplary embodiment of the invention includes the associated particle as described above, and a ratio thereof, when expressed by (N2/(N1+N2)×100) in which the particle number of the single particles is designated as N1 and the particle number of the associated particles is designated as N2, is preferably from 30% by number or about 30% by number to 95% by number or about 95% by number, more preferably from 50% by number or about 50% by number to 90% by number or about 90% by number. When the ratio of the associated particle is less than 30% by number, the effect of suppressing formation of a closest packing structure is small, and concentration fluctuation per image is increased in some cases and, when the ratio is more than 95% by number, an image defect is generated in some cases.

Herein, the particle number ratio N2/(N1+N2) is obtained as follows. First, 100 carrier particles observed in the observation field are randomly selected with a scanning electron microscope whether a single particle or an associated particle. Subsequently, what the number (i.e. number N2) of associated particles is present in 100 selected carrier particles (i.e. N1+N2) is counted. Also, from these values, the particle number ratio N2/(N1+N2) is calculated.

The average particle diameter Dt of the carrier for replenishment of the present exemplary embodiment of the invention is preferably from 50 μm or about 50 μm to 300 μm or about 300 μm, more preferably from 60 μm or about 60 μm to 250 μm or about 250 μm, further preferably from 75 μm or about 75 μm to 200 μm or about 200 μm. When the average particle diameter Dt of the carrier for replenishment is less than 50 μm, the effect of suppressing dense aggregation is not exerted in some cases and, when the average particle diameter is more than 300 μm, upon formation of a developer brush on a developer holding member, sufficient dissociation into single particles does not occur, and a fine cluster is not formed in some cases. In addition, a stress on the toner becomes great in some cases.

Herein, the average particle diameter Dt of the carrier for replenishment is obtained as follows. First, only 100 single particles confirmed in the observation field upon observation of the carrier with a scanning electron microscope are selected. Subsequently, the diameter corresponding to a true circle having the same area as an area of individual single particles (true circle corresponding diameter) is obtained. Finally, an average of this true circle corresponding diameter is obtained, and this is defined as average particle diameter D1. In addition, the average particle diameter D2 of the associated particle is obtained by the similar procedure.

Further, the average particle diameter Dt of the carrier for replenishment is obtained based on the following equation (1) from the average particle diameter D1 and the average particle diameter D2.

$$Dt=D1\times N1/(N1+N2)+D2\times N2/(N1+N2) \quad \text{Equation (1)}$$

In the equation (1), D1 represents the average particle diameter of a single particle, D2 represents the average particle diameter of an associated particle, N1 represents the particle number of single particles, and N2 represents the particle number of associated particles.

In addition, the carrier for replenishment of the present exemplary embodiment of the invention has the shape factor of preferably from 110 or about 110 to 230 or about 230, more preferably from 130 or about 130 to 220 or about 220, further preferably from 140 or about 140 to 200 or about 200. When the shape factor is less than 110, the effect of suppressing dense aggregation is not exerted in some cases and, when the shape factor is more than 230, upon formations of a developer brush on a developer holding member, sufficient dissociation into single particles does not occur, and a fine cluster is not formed in some cases. In addition, toner consumption occurs remarkably in some cases.

Herein, the shape factor of the carrier for replenishment is obtained as follows. One hundred of carrier particles in the observation field observed with a scanning electron microscope are randomly sampled, its image information is introduced into an image analyzing apparatus via an interface to perform analysis, and the coefficient is calculated by the following equation. In the equation, R represents the maximum length, and S represents the projected area.

$$\text{Shape factor}=R^2/S\times\pi/4\times 100$$

—Core Material—

A core material in the carrier for replenishment of the present exemplary embodiment of the invention is not particularly limited, but the known core material for a carrier is used. Examples include magnetic metals such as iron, nickel, cobalt, magnetic oxides such as ferrite, and magnetite, magnetic powder-dispersed particles in which magnetic powders are dispersed in a resin, and glass beads, and a magnetic powder-dispersed particle is preferable from the view point that a stress is not applied on the toner, and concentration fluctuation is more suppressed. The volume average particle diameter of the core material is preferably from 10 μm or about 10 μm to 150 μm or about 150 μm, more preferably from 30 μm or about 30 μm to 100 μm or about 100 μm.

On the other hand, as a magnetic powder used in the magnetic powder-dispersed particle, any of the previously known magnetic powders may be used, and ferrite, magnetite and maghematite are preferable. Particularly, as a ferromagnetic magnetic powder particle, magnetite and maghematite are selected and, as other magnetic powder particle, for example, an iron powder is known. Since in the case of the iron powder, a specific gravity is great, a toner is easily deteriorated, therefore, ferrite, magnetite and maghematite are excellent in stability. An example of ferrite is generally represented by the following formula (3).

$$(MO)_X(Fe_2O_3)_Y \qquad \text{Formula (3)}$$

(in the formula, M contains at least one kind selected from Cu, Zn, Fe, Mg, Mn, Ca, Li, Ti, Ni, Sn, Sr, Al, Ba, Co, and Mo: and X and Y represent the weight mol ratio, provided that a condition X+Y=100 is satisfied)

A ferrite particle in which the M is one kind or a combination of a few kinds of Li, Mg, Ca, Mn, Sr or Sn, and the content of other components is 1% by weight or less is preferable. By adding Cu, Zn or Ni element, a low resistance is easily obtained, and charge leakage is easily caused. In addition, there is a tendency that covering with a resin is difficult, and environmental dependency is deteriorated. Further, due to a heavy metal and a great specific gravity, a stress applied to a carrier becomes large, adversely influencing on a life in some cases.

In addition, from the view point of safety, in recent years, a magnetic particle containing Mn or Mg element is generally spread. A ferrite core material is suitable and, as a raw material of a magnetic particle, as a magnetic powder particle contained in a magnetic powder-dispersed resin core used, containing $Fe_2O_3$ as an essential component, a ferromagnetic iron oxide particle powder such as magnetite and maghemite, a spinel ferrite particle powder containing one or two or more kinds of metals other than iron (Mn, Ni, Zn, Mg, Cu etc.), a magnet plumbite-type ferrite particle powder such as barium ferrite, and a particle powder of iron or iron alloy having an oxidized film on a surface are used.

Specifically, examples of the magnetic powder include iron-based oxides such as magnetite, γ-iron oxide, Mn—Zn-based ferrite, Ni—Zn-based ferrite, Mn—Mg-based ferrite, Li-based ferrite, and Cu—Zn-based ferrite. Among them, inexpensive magnetite is more preferably used. These magnetic powders may be used alone, or two or more kinds may be used together.

The volume average particle diameter of the magnetic powder is preferably in the range of from 0.01 μm or to 1 μm, more preferably in the range of from 0.03 μm to 0.5 μm, further preferably in the range of from 0.05 μm to 0.35 μm. When the volume average particle diameter of the magnetic powder is less than 0.01 μm, reduction in a magnetic force is caused, or the viscosity of a composition solution is increased, and a core material having no fluctuation of a particle diameter is not obtained in some cases. On the other hand, when the particle diameter of the magnetic powder is more than 1 μm, a homogeneous core material may not be obtained in some cases.

The volume average particle diameter of the magnetic powder is measured with a laser diffraction/scattering-type particle size distribution measuring device.

The content of the magnetic powder in the core material is preferably in the range of from 30% by weight to 98% by weight, more preferably in the range of from 45% by weight to 95% by weight, further preferably in the range of from 60% by weight to 95% by weight. When the content is less than 30% by weight, since a magnetic force per carrier is low, a constraining force is not obtained and, as a result, scattering is caused in some cases and, when the content is more than 98% by weight, not only spherization becomes difficult, but also the strength is reduced in some cases. In addition, the stress on the toner becomes great, and a cluster of the carrier becomes hard in some cases.

Examples of a resin component constituting the magnetic powder-dispersed particle include a crosslinked styrene-based resin, an acryl-based resin, a styrene-acryl-based copolymer resin, and a phenol-based resin.

In addition, the core material of the carrier may further contain other component depending on the purpose. Examples of the other component include charge controlling agents, and fluorine-containing particles.

As a method for producing the magnetic powder-dispersed particle, for example, a melt-kneading method of melt-kneading the magnetic powder and a resin such as a styrene acrylic resin using a Banbury mixer, or a kneader, cooling this, followed by grinding and classification (JP-B No. 59-24416, JP-B No. 8-3679 etc.), a suspension polymerization method of dispersing a monomer unit of a binding resin and a magnetic powder in a solvent to prepare a suspension, and polymerizing this suspension (JP-A No. 5-100493 etc.), and a spray drying method of mixing and dispersing a magnetic powder in a resin solution, and spray-drying this are known.

Any of the melt-kneading method, the suspension polymerization method and the spray-drying method includes a step of preparing a magnetic powder by any method in advance, mixing this magnetic powder and a resin solution, and dispersing the magnetic powder in the resin solution.

—Resin Layer—

Examples of a resin used in a resin layer covering the core material include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymer, styrene-acrylic acid copolymer, a straight silicone resin constituting an organosiloxane bond or modified product thereof, fluorine resin, polyester, polycarbonate, phenol resin, and epoxy resin, being not limiting.

The amount of the resin covering the core material is preferably in the range of from 0.1 parts by weight or about 0.1 parts by weight to 10 parts by weight or about 10 parts by weight, preferably in the range of from 0.5 parts by weight or about 0.5 parts by weight to 10 parts by weight or about 10 parts by weight, more preferably in the range of from 1 part by weight or about 1 part by weight to 5 parts by weight or about 5 parts by weight, further preferably from 1 part by weight or about 1 part by weight to 3 parts by weight or about 3 parts by weight based on 100 parts by weight of the core material. When the resin amount is less than 0.5 parts by weight, since exposure of the core material on a surface is too much, injection of the development electric field becomes easy in some cases. On the other hand, when the resin amount is more than 10 parts by weight, a resin powder released from the resin layer is increased, and a peeled carrier resin powder is contained in a developer from an initial stage, in some cases.

The resin layer may contain an electrically conductive powder, if necessary, for the purpose of controlling a resistance.

Specifically, examples of the electrically conductive powder (substance used for reducing electric resistance) include metal particles such as gold, silver, and copper; carbon black; ketjen black; acetylene black; titanium oxide, zinc oxide, and oxide particles (particles in which a surface of titanium oxide, zinc oxide, barium sulfate, aluminum borate, or potassium titanate is covered with tin oxide, carbon black, or metal). These may be used alone, or two or more may be used together.

As the electrically conductive powder, a carbon black particle is preferable from the viewpoint of effect of production stability, and reduction in the cost and the electrical resistance being good.

The kind of carbon black is not particularly limited, but carbon black having the DBP oil absorption of from 50 ml/100 g to 250 ml/100 g is excellent in production stability, and is preferable.

The volume average particle diameter of the electrically conductive powder is preferably 0.5 μm or less, more preferably in the range of from 0.05 μm to 0.5 μm, further preferably in the range of from 0.05 μm to 0.35 μm. When the volume average particle diameter is less than 0.05 μm, conversely, aggregating property of the electrically conductive powder is deteriorated, and a difference in the volume resistance between carrier particles is easily caused and, when the volume average particle diameter is more than 0.5 μm, the electrically conductive powder is easily dropped from the resin layer, and stable charging property is not obtained in some cases.

The volume average particle diameter of the electrically conductive powder is measured using a laser diffraction-type particle size distribution measuring apparatus (trade name: LA-700, manufactured by Horiba Ltd.).

As a measuring method, 2 g of a measurement sample is added to 50 ml of a 5% aqueous solution of a surfactant, preferable, sodium alkylbenzene sulfonate, the sample is dispersed with an ultrasound dispersing machine (1,000 Hz) for 2 minutes to prepare a sample, and this is measured.

The resulting volume average particle diameter for every channel is accumulated from the smaller volume average particle diameter and, at accumulation of 50%, this is adopted as volume average particle diameter.

The volume electric resistance of the electrically conductive powder is preferably from $10^1$ Ω·cm to $10^{12}$ Ω·cm, more preferably from $10^3$ Ω·cm to $10^9$ Ω·cm.

In addition, the volume electric resistance of the electrically conductive powder is measured as in the same manner as in the volume electric resistance of the core material.

The content of the electrically conductive powder is preferably from 0.05% by weight to 1.5% by weight, and more preferably from 0.10% by weight to 1.0% by weight, based on the total resin layer. When the content is more than 1.5% by weight, the carrier resistance is reduced, and an image defect is caused by adhesion of the carrier to a developer in some cases. On the other hand, when the content is less than 0.05% by weight, the carrier is insulated, it becomes difficult for the carrier to work as a development electrode at the time of development and, particularly, upon formation of a black plain image, reproduction of a solid image is inferior, such as manifestation of the edge effect.

In addition, the resin layer may contain another resin particle. Examples of the resin particle include a thermoplastic resin particle and a thermosetting resin particle. Among these, from the view point of easy relative increase in hardness, the thermosetting resin is preferable and, from the view point of impartation of negative charging property to the toner, a resin particle obtained from a nitrogen-containing resin containing an N atom is preferable. These resin particles may be used alone, or two or more kinds may be used together.

The volume average particle diameter of the resin particle is, for example, preferably from 0.1 μm to 2.0 μm, and more preferably from 0.2 μm to 1.0 μm. When the average particle diameter of the resin particle is less than 0.1 μm, dispersibility of the resin particle in the resin layer becomes very worse in some cases and, on the other hand, when the average particle diameter is more than 2.0 μm, the resin particle is easily dropped off from the resin layer, and the effects may not exerted in some cases.

The volume average particle diameter of the resin particle is obtained by performing measurement as in the same manner as in the volume average particle diameter of the electrically conductive powder.

The content of the resin particle is preferably from 1% by volume to 50% by volume, and more preferably from 1% by volume to 30% by volume, further preferably from 1% by volume to 20% by volume based on the total resin layer. When the content of the resin particle is less than 1% by volume, the effect of the resin particle is not manifested in some cases and, when the content is more than 50% by volume, dropping off from the resin layer is easily caused, and stabile charging property is not obtained in some cases.

The covering rate of the core material surface with the resin layer is preferably 95% or more or about 95% or more, more preferably 98% or more or about 98% or more, most preferably 100% or about 100%. When the covering rate is less than 95%, injection of charges into the carrier is generated when used over a long period of time, the carrier in which charge injection has occurred is transferred onto the electrostatic latent image holding member, and white spots are generated on an image in some cases.

The covering rate of the resin layer is obtained by XPS measurement (X-ray photoelectron spectrometry). As the XPS measuring apparatus, JPS80 manufactured by JEOL Ltd. and, for measurement, MgKα-ray is used as a X-ray source, and measurement is performed by setting an acceleration voltage at 10 kV, and an emission current at 20 mV.

—Various Physical Properties of Carrier—

Saturated magnetization of the carrier is preferably 40 emu/g or more, more preferably 50 emu/g or more.

As an apparatus for measuring magnetic property, a vibration sample-type magnetization measuring apparatus (trade name: VSMP10-15, manufactured by Toei Industry Co., Ltd.) is used. A measurement sample is packed in a cell having the internal diameter of 7 mm and the height of 5 mm, and this is set in the apparatus. For measurement, the application magnetic field is applied, and sweeping is performed up to a maximum of 1000 oersted. Then, the application magnetic field is reduced, and a hysteresis curve is produced on a recording paper. From data of the curve, saturated magnetization, residual magnetization, and a coercive force are obtained. In the invention, saturated magnetization indicates magnetization measured in the magnetic field at 1000 oersted.

The volume resistivity of the carrier is controlled preferably in the range of from $1\times10^5$ Ω·cm to $1\times10^{15}$ Ω·cm, and more preferably in the range of from $1\times10^8$ Ω·cm to $1\times10^{14}$ Ω·cm, further preferably in the range of from $1\times10^8$ Ω·cm to $1\times10^{13}$ Ω·cm. When the volume electric resistance of the carrier is more than $1\times10^{15}$ Ω·cm, since the resistance becomes high resistance, and it becomes difficult for the carrier to work as a development electrode at the time of development, particularly, solid reproduction is reduced in some cases, such as manifestation of the edge effect at a plain image part. On the other hand, when the volume electric resistance is less than $1\times10^{5}$ Ω·cm, since the resistance becomes low resistance, at reduction in the toner concentration in the developer, charges are injected from a development roll into the carrier, and a disadvantage that the carrier itself is developed is easily generated in some cases.

The volume electric resistance of the carrier is measured as in the same manner as in the volume electric resistance of the magnetic particle.

—Method for Manufacturing Carrier—

Upon manufacturing of the carrier, when the resin layer is formed on a surface of the core material, a solution for forming a resin layer obtained by dissolving various components such as a resin constituting the resin layer in an appropriate solvent is used.

The solvent of the solution for forming a resin layer is not particularly limited, but may be selected in view of a resin used, and a method of coating the solution for forming a resin layer on the core material, and examples include aromatic hydrocarbons such as toluene, and xylene; ketones such as acetone, and methyl ethyl ketone; ethers such as tetrahydrofuran, and dioxane.

Examples of a specific method of forming the resin layer include an immersion method of immersing the core material in the solution for forming a resin layer, a spray method of spraying the solution for forming a resin layer to a surface of the core material, a fluidized method of spraying the solution for forming a resin layer in the state where the core material is floated with the flowing air, and a kneader coater method of mixing the core material and the solution for forming a resin layer in the kneader coater, and removing a solvent.

When the kneader coater method is utilized, by controlling a blade rotation speed of a coating apparatus such as a vacuum degassing-type kneader at a lower rotation speed as compared with manufacturing of a conventional carrier consisting only of single particles, associated particles are manufactured together with the single particles. For this reason, by utilizing this method, the carrier related to the present exemplary embodiment of the invention is manufactured at once.

In addition, by using pre-manufactured single particles, heating them at a temperature at which the resin layer is fused to prepare associated particles, classifying these with a sieve, and mixing this with the single particles, the carrier of the present exemplary embodiment of the invention is manufactured.

<Developer for Replenishment>

The developer for replenishment of the present exemplary embodiment of the invention is a two-component developer containing the already described carrier for replenishment for the present exemplary embodiment of the invention, and a toner. The ratio of the toner relative to 100 parts by weight of the carrier for replenishment of the present exemplary embodiment of the invention in the two-component developer is preferably from 70 parts by weight to 95 parts by weight.

As the toner constituting the developer for replenishment of the present exemplary embodiment of the invention together with the carrier for replenishment of the present exemplary embodiment of the invention, the same toner as that of a developer used in image formation described later (initial developer) is used, and in the developer for replenishment of the present exemplary embodiment of the invention, particularly, a toner having the volume average particle diameter (Dv) of from 2.0 μm to 7.0 μm (more preferably from 3.0 μm to 6.0 μm), and a value obtained by dividing the volume average particle diameter (Dv) by the number average particle diameter (Dn) of the toner of from 1.0 to 1.25 (more preferably from 1.0 to 1.20) is preferable in that the effect of forming a fine cluster in a surface of the developer holding member, and obtaining an image with suppressed concentration fluctuation and roughness on a surface over a long period of time is exerted.

Herein, the volume average particle diameter (Dv) of the toner and the number average particle diameter (Dn) of the toner are measured by the following method.

Those particle diameters are measured using a measuring equipment such as Coulter Multimizer II (manufactured by Beckmann Coulter) and employing, as an electrolyte solution, ISOTON-II (manufactured by Beckman Coulter).

Upon measurement, 0.5 mg or more and 50 mg or less of a measurement sample is added to 2 ml of a 5% aqueous solution of a surfactant (preferably, sodium alkylbenzene sulfonate) as a dispersant. This is added to 100 ml or more and 150 ml or less of an electrolyte solution.

The electrolyte solution in which the sample is suspended is subjected to dispersing treatment with an ultrasound dispersing equipment for about 1 minute, and a particle size distribution of particles having the particle diameter in the range of from 2 μm to 60 μm is measured with the Coulter Multimizer II using a 100 μm aperture as an aperture diameter. The number of particles to be sampled is 50000.

An accumulation distribution of each of the volume and the number is drawn from a small diameter side against a divided particle size range (channel) based on the resulting particle size distribution, and the particle diameter at accumulation of 50% is obtained as volume average particle diameter (Dv) or number average particle diameter (Dn).

The toner used in the present exemplary embodiment of the invention will be explained in more detail below.

Examples of a binder resin of the toner include homopolymers or copolymers such as monoolefins such as ethylene, propylene, butylene, and isoprene; vinyl esters such as vinyl acetate, vinyl propionate, vinyl benzoate, and vinyl butyrate; α-methylene aliphatic monocarboxylic acid esters such as methyl acrylate, phenyl acrylate, octyl acrylate, methyl methacrylate, ethyl methacrylate, butyl methacrylate, and dodecyl methacrylate; vinyl ethers such as vinyl methyl ether, vinyl ethyl ether, and vinyl butyl ether; vinyl ketones such as vinyl methyl ketone, vinyl hexyl ketone, and vinyl isopropenyl ketone. Among them, examples of a particularly representative binder resin include polystyrene, styrene-alkyl acrylate copolymer, styrene-butadiene copolymer, styrene-maleic anhydride copolymer, polystyrene and polypropylene. Further examples include polyester, polyurethane, epoxy resin, silicone resin, polyamide, and modified rosin.

Examples of a crystallizable binding resin include polyester resins formed by condensation of a dialcohol such as nonanediol, decanediol, or dodecanediol having, as a main chain, an alkyl group in which 6 or more methylene groups are connected in a straight manner and dicarboxylic acid such as decanedioic acid and dodecanedioic acid, and resins having, as a polymerization unit, decyl acrylate, dodecyl acrylate, and stearyl acrylate having, as a side chain, the alkyl group in which 6 or more methylene groups are connected in a straight manner.

The coloring agent is not particularly limited, but includes carbon black, aniline blue, Chalcoyl Blue, Chrome Yellow, Ultramarine Blue, Dupont Oil Red, Quinoline Yellow, Methylene Blue Chloride, Phthalocyanine Blue, Malachite Green Oxalate, Lamp Black, Rose Bengal, C.I. Pigment Red 48:1, C.I. Pigment Red 122, C.I. Pigment Red 57:1, C.I. Pigment Yellow 97, C.I. Pigment Yellow 12, C.I. Pigment Blue 15:1, and C.I. Pigment Blue 15:3.

In addition, the toner may contain a charge controlling agent, if necessary. Thereupon, when the agent is used particularly in a color toner, a colorless or pale-colored charge controlling agent imparting no influence on a color tone is preferable. As the charge controlling agent, the known agent is used, and it is preferable to use an azo-based metal complex; a metal complex such as salicylic acid or alkyl salicylic acid or metal salt thereof.

Further, the toner may contain a releasing agent, if necessary, for the purpose of preventing offset.

Examples of the releasing agent include the following: paraffin wax and a derivative thereof, montan wax and derivatives thereof, microcrystalline wax and derivatives thereof, Fischer Tropsh wax and derivatives thereof, and polyolefin wax and derivatives thereof. The derivative includes oxide, polymer with a vinyl monomer, and a graft-modified substance. Besides, alcohol, fatty acid, vegetable-based wax, animal-based wax, mineral-based wax, ester-based wax, and acid amide may be utilized.

In addition, an inorganic oxide particle may be added to the interior of the toner. Examples of the inorganic oxide particle include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$. Among them, particularly, a silica particle, and a titania particle are preferable. A surface of the oxide particle may not be necessarily hydrophobicization-treated in advance, and may be hydrophobicization-treated. When the toner is hydrophobicization-treated, in the case where a part of the inorganic particle in the interior is exposed on a toner surface, environmental dependency of charging, and carrier staining property are effectively suppressed to little.

The hydrophobicization treatment is performed by immersion of inorganic oxide in a hydrophobicization-treating agent. The hydrophobicization-treating agent is not particularly limited, but examples include a silane coupling agent, a silicone oil, a titanate-based coupling agent, and an aluminum-based coupling agent. These may be used alone, or two or more kinds may be used together. Among them, a silane coupling agent is suitably exemplified.

As the silane coupling agent, for example, any type of chlorosilane, alkoxysilane, silazane, and special silylating agent may be used. Specifically, examples include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltriethoxysilane, decyltrimethoxysilane, hexamethyldisilazane, N,O-(bistrimethylsilyl)acetamide, N,N-(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysitane, γ-mercaptopropyltrimethoxysilane, and γ-chloropropyltrimethoxysilane.

The amount of the hydrophobicization-treating agent is different depending on the kind of the inorganic oxide particle, may be not generally defined, but is usually preferably from 5 parts by weight to 50 parts by weight, based on 100 parts by weight of inorganic oxide particle.

In addition, the inorganic oxide particle may be added to a toner surface. As the inorganic oxide particle to be added to a toner surface, $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$ are exemplified. Among them, particularly, a silica particle and a titania particle are preferable. It is desirable that a surface of the oxide particle is hydrophobicization-treated in advance. By this hydrophobicization-treatment, in addition to improvement in powder flowability of the toner, environmental dependency of charging, and a carrier staining property are effectively suppressed to little.

The hydrophobicization-treatment is performed by immersing the inorganic oxide in a hydrophobicization-treating agent as described above. The hydrophobicization-treating agent is not particularly limited, but examples include a silane coupling agent, a silicone oil, a titanate-based coupling agent, and an aluminum-based coupling agent. These may be used alone, or two or more kinds may be used together. Among them, the silane coupling agent is suitably exemplified.

As a method of manufacturing the toner, a kneading grinding method and a wet granulation method which are generally used are utilized. Herein, as the wet granulation method, a suspension polymerization method, an emulsion polymerization method, an emulsion polymerization aggregation method, a soap-free emulsion polymerization method, a non-aqueous dispersion polymerization method, an in-situ polymerization method, an interface polymerization method, an emulsion dispersion granulation method, and an aggregation-coacervation method are used.

For manufacturing the toner by the kneading grinding method, a binder resin and, if necessary, a coloring agent and other additive are sufficiently mixed with a mixing machine such as a Henschel mixer, or a ball mill, melt-kneaded using a heat kneading machine such as a heat roll, a kneader, and an extruder to compatibilize resins, an infrared absorbing agent and an antioxidant are dispersed or dissolved therein and, after cooling to solidification, grinding and classification are performed to obtain a toner.

<Image Forming Apparatus, Developer Cartridge for Replenishment>

The image forming apparatus of the present exemplary embodiment of the invention is an image forming apparatus of a trickle development system having a latent image holding member, an electrostatic latent image forming unit that forms an electrostatic latent image on the latent image holding member, a development unit that develops the electrostatic latent image on the latent image holding member with a developer containing a toner to form a toner image, a transfer unit that transfers the toner image onto a material to be transferred, and a fixing unit that fixes the toner image transferred onto the material to be transferred, and which performs development while a developer for replenishment is replenished upon the development, and as the developer for replenishment, the already described developer for replenishment of the present exemplary embodiment of the invention is used.

In addition, a developer cartridge for replenishment of the present exemplary embodiment of the invention accommodates a developer for replenishment of a trickle development system of performing development while the developer for replenishment is replenished upon development of the latent image on the latent image holding member using a development unit, and the developer for replenishment is the already described developer for replenishment of the present exemplary embodiment of the invention.

The image forming apparatus and the developer cartridge for replenishment of the present exemplary embodiment of the invention will be explained below using the drawings.

Figure 2:
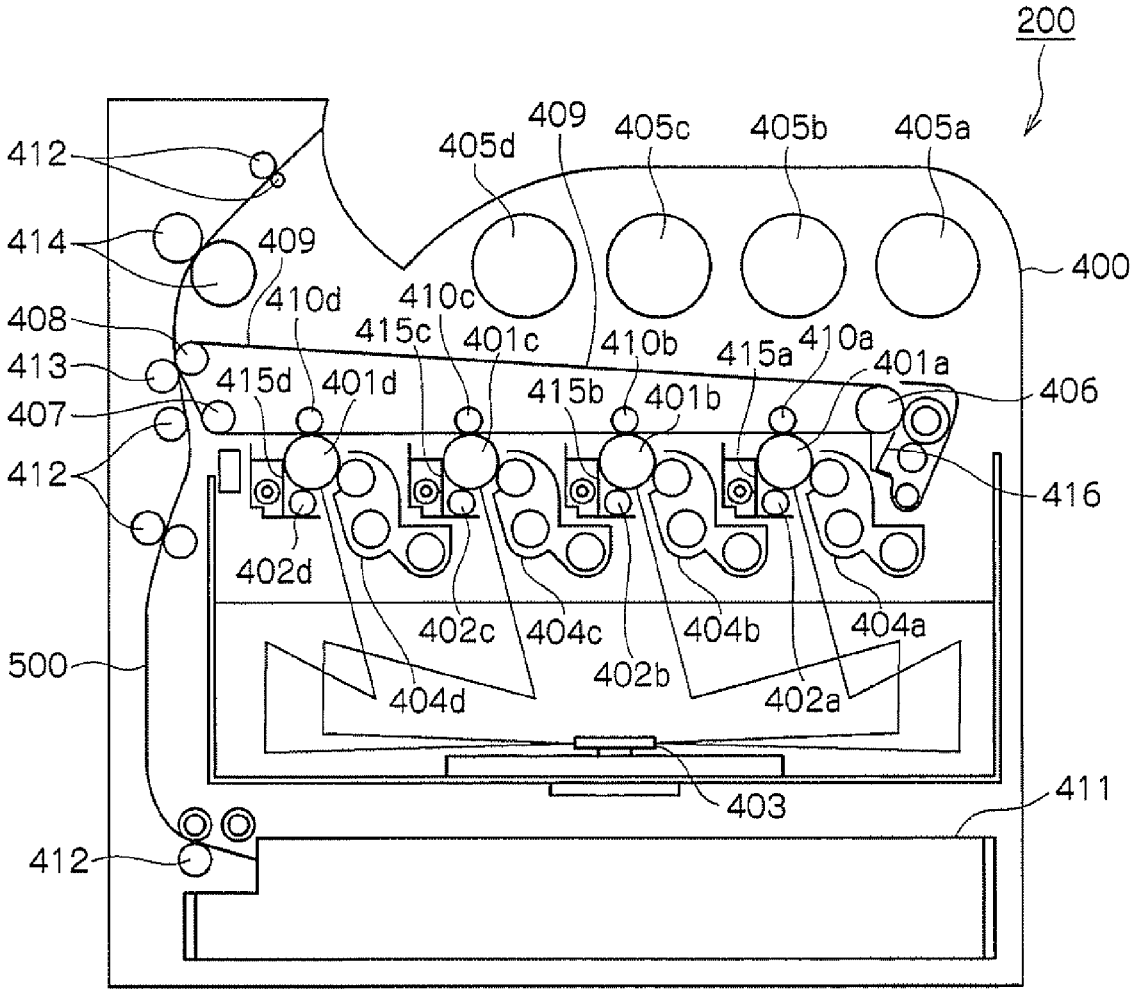
FIG. 2 is a schematic view showing an example of an image forming apparatus of the present exemplary embodiment of the invention.

FIG. 2 is a schematic construction view showing schematically a fundamental construction one example of the image forming apparatus of the present exemplary embodiment of the invention. An image forming apparatus 200 shown in FIG. 2 is an image forming apparatus for forming a color image of an intermediate transfer system.

In the image forming apparatus 200 shown in FIG. 2, in a housing 400, four electrophotographic photoreceptors (latent image holding member) 401*a* to 401*d* are arranged parallel along an intermediate transfer belt 409.

Electrophotographic photoreceptors 401*a* to 401*d* are such that, for example, an electrophotographic photoreceptor 401*a* forms a yellow image, an electrophotographic photoreceptor 401*b* forms a magenta image, an electrophotographic photoreceptor 401*c* forms a cyan image, and an electrophotographic photoreceptor 401*d* forms a black image, respectively.

Each of electrophotographic photoreceptors 401*a* to 401*d* is rotated (counter-clockwise on a paper) and, along its rotation direction, charging rolls 402*a* to 402*d*, development apparatuses (development units) 404*a* to 404*d*, primary transfer rolls (transfer unit) 410*a* to 410*d*, and cleaning blades 415*a* to 415*d* are arranged. Each of four color toners of black, yellow, magenta and cyan accommodated in each of developer cartridge for replenishment 405*a* to 405*d*, and the developer for replenishment of the present exemplary embodiment of the invention containing the carrier for replenishment of the present exemplary embodiment of the invention are supplied to each of development apparatuses 404*a* to 404*d*, and each of primary transfer rolls 410*a* to 410*d* is contacted with each of electrophotographic photoreceptors 401*a* to 401*d* via intermediate transfer belt 409.

Further, an exposure apparatus 403 is arranged in the housing 400, a light beam emitted from the exposure apparatus 403 is irradiated to surfaces of electrophotographic photoreceptors 401*a* to 401*d* after charging, thereby, an electrostatic latent image is formed on each surface of electrophotographic photoreceptors 401*a* to 401*d*. Thereby, in a step of rotating electrophotographic photoreceptors 401*a* to 401*d*, each step of charging, light exposure, development, primary transfer, and cleaning is sequentially performed, and a toner image of each color is overlappedly transferred onto an intermediate transfer belt 409.

The intermediate transfer belt 409 is supported by a tension with a driving roll 406, and rolls 408 and 407, and is rotated by rotation of these rolls without causing deflection. In addition, a secondary transfer roll 413 is arranged so as to contact with a roll 408 via the intermediate transfer belt 409. The intermediate transfer belt 409 which has passed while it is held between the roll 408 and the secondary transfer roll 413 is cleaned in a surface, for example, with a cleaning blade 416, and is repeatedly supplied to a next image forming process.

In addition, in the housing 400, an accommodating member (material to be transferred-accommodating member) 411 is provided, and a medium to be transferred (material to be transferred) 500 such as a paper in the accommodating member 411 is supplied with a carrying belt 412 to a position where it is held by the intermediate transfer belt 409 and the secondary transfer roll 413 and, further, is sequentially transferred while it is held by two fixation rolls 414 which are mutually contacted, and is discharged to the outside of the housing 400.

In the image forming apparatus 200 shown in FIG. 2, development apparatuses 404*a* to 404*d* perform development while the already described developer for replenishment of the present exemplary embodiment of the invention is replenished from developer cartridges for replenishment 405*a* to 405*d*. In the image forming apparatus 200 shown in FIG. 2, a preferable example of the developer cartridge for replenishment represented by 405*a* to 405*d*, and the development apparatus represented by 404*a* to 404*d* will be explained below.

Figure 3:
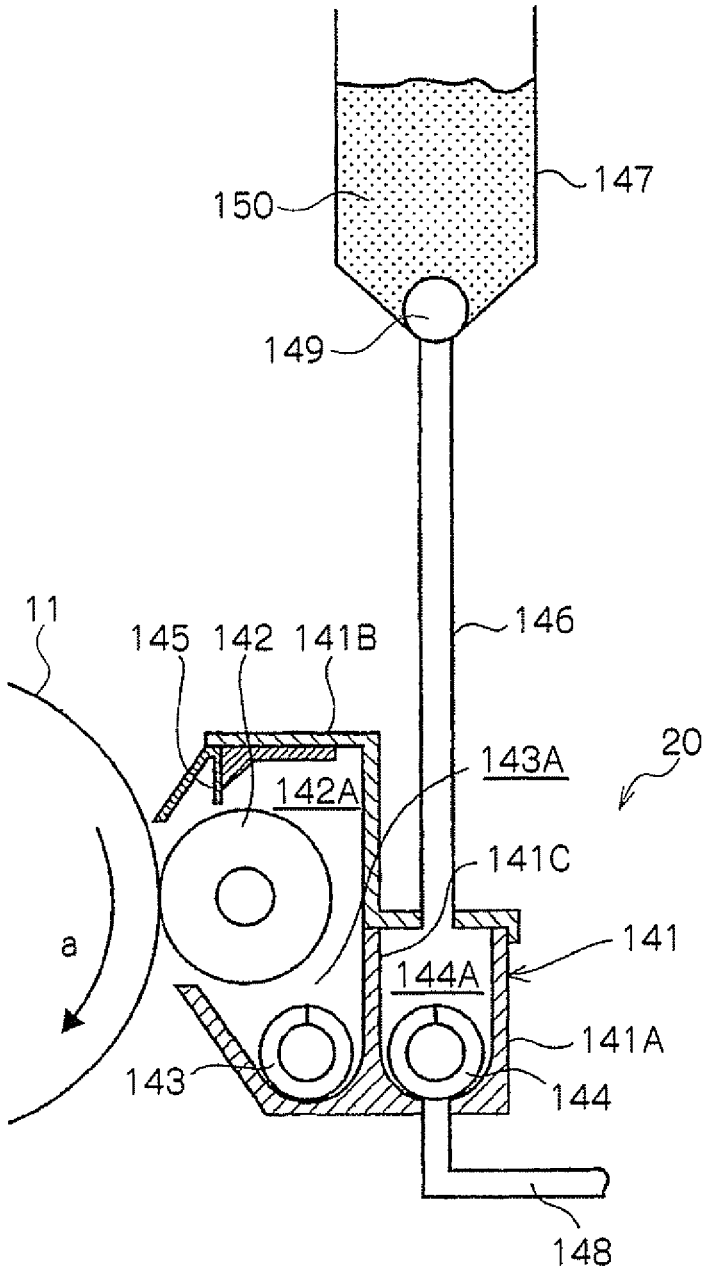
FIG. 3 is a schematic view showing an example of a developing apparatus in the present exemplary embodiment of the invention.

One example of the development apparatus (development unit) in the present exemplary embodiment of the invention will be explained with reference to FIG. 3. FIG. 3 is a schematic construction view showing an example of the development apparatus in the present exemplary embodiment of the invention.

In FIG. 3, the development apparatus 20 is arranged opposite to an electrostatic latent image holding member 11 in a development region and, for example, has a developer accommodating container 141 that accommodates a two-component developer composed of a toner charged with negative (−) polarity and a carrier charged with positive (+) polarity. The developer accommodating container 141 has a developer accommodating container body 141A and a developer accommodating container cover 141B blocking the upper end thereof.

The developer accommodating container body 141 has a development roll chamber 142A for accommodating a development roll (developer holding member) 142 in the interior thereof, and has a first stirring chamber 143A, and a second stirring chamber 144A adjacent to the first stirring chamber 143A, adjacent to the development roll chamber 142A. In addition, in the development roll chamber 142A, a layer thickness regulating member 145 for regulating the layer thickness of a developer on a surface of the development roll 142 when the developer accommodating container cover 141B is fitted in the developer accommodating container body 141A is provided.

The first stirring chamber 143A and the second stirring chamber 144A are partitioned with a partition wall 141C for isolating those chambers, a passageway is provided on both ends in a longitudinal direction (longitudinal direction of the development apparatus) of the partition wall 141C of the first stirring chamber 143A and the second stirring chamber 144A although not shown in the drawings, and a circulation stirring chamber (143A+144A) is constructed by the first stirring chamber 143A and the second stirring chamber 144A.

In the development roll chamber 142A, a development roll 142 is arranged so as to face an electrostatic latent image holding member 11. Although not shown in the drawings, the development roll 142 is configured by providing a sleeve on an external side of a magnetic roll (fixed magnet) having magnetism. A developer of the first stirring chamber 143A is adsorbed onto a surface of the development roll 142 with a magnetic force of the magnetic roll, and is conveyed to the development region. In addition, a roll axis of the development roll 142 is rotatably supported by the developer accommodating container body 141A. Herein, the development roll 142 and the electrostatic latent image holding member 11 are rotated in reverse directions and, at the facing part, the developer adsorbed onto a surface of the development roll 142 is conveyed to the development region in the same direction as a progression direction (arrow a) of the electrostatic latent image holding member 11.

A bias electric source which is not shown in the drawings is connected to the sleeve of the development roll 142, and a development bias is applied thereto (in the present exemplary embodiment of the invention, a bias in which an alternating current component (AC) is overlapped with a direct current component (DC) is applied so that the alternating electric field is applied to the development region).

In the first stirring chamber 143A and the second stirring chamber 144A, a first stirring conveyance member 143 and a second stirring conveyance member 144 for conveying the developer while it is stirred are arranged. The first stirring member 143 is constructed of a first rotation shaft extending in a direction of an axis of the development roll 142, and a stirring conveyance blade (projection part) which is spirally fixed on an outer periphery of the rotation shaft. In addition, the second stirring member 144 is also constructed of a second rotation shaft and a stirring conveyance blade (projection part) like the first stirring member 143. The stirring member is rotatably supported at the developer accommodating container body 141A. Also, the first stirring member 143 and the second stirring member 144 are arranged so that developer in the first stirring chamber 143A and developer in the second stirring chamber 144A are conveyed in reverse directions by their rotation.

One end of a developer supply unit 146 for appropriately supplying a supply developer containing a supply toner and a supply carrier to the second stirring chamber 144A is connected to a one end side in a longitudinal direction of the second stirring chamber 144A, and a developer cartridge 147 for accommodating a supply developer is connected to the other end of the developer supply unit 146. In addition, one end of a developer discharge unit 148 for appropriately discharging an accommodated developer is also connected to another one end side in a longitudinal direction of the second stirring chamber 144A, and the other end of the developer discharging unit 148 is connected to a developer recovery container for recovering a discharged developer which is not shown in the drawings.

The development apparatus 20 adopts a so-called trickle development system of arbitrarily supplying the supply developer from the developer cartridge 147 to the development apparatus 20 (second stirring chamber 144A) via the developer supply unit 146, and arbitrarily discharging the used developer through the developer discharging unit 148 (a development system of performing development while discharging an excessive deteriorated developer (containing many deteriorated carriers), while the supply developer (trickle developer) is gradually supplied to the development apparatus, for preventing reduction in the charging performance of the developer to prolong an interval of developer exchange).

The developer cartridge 147 accommodates the developer for replenishment 150, and supplies the developer for replenishment 150 to the development apparatus 20. In addition, the developer cartridge 147 has a stirring member 149. This stirring member 149 is not essential, but by stirring the developer for replenishment 150 to some extent, an associated particle in the developer for replenishment 150 is dissociated in the development apparatus 20, and the effect of forming a finer cluster on a surface of the development roll (developer holding member) 142, and obtaining an image with suppressed concentration fluctuation and roughness on a surface over a long period of time becomes more remarkable. Examples of the stirring member 148 include a coil member.

The image forming apparatus of the present exemplary embodiment of the invention is preferably such that the developer unit has a stirring conveyance member. By the development unit having the stirring conveyance member, since the developer for replenishment 150 supplied from the developer cartridge 147 is conveyed to the development roll 142 while it is stirred, an associated particle of the developer for replenishment 150 conveyed to the development roll 142 is dissociated, and the effect of forming a fine cluster on a surface of the development roll 142, and obtaining an image with suppressed concentration fluctuation and roughness of a surface over a long period of time becomes more remarkable.

The stirring conveyance member corresponds to the first stirring conveyance member 143 and the second stirring conveyance member 144 in the development apparatus 20 shown in FIG. 3. The shape of the stirring conveyance member is not particularly limited as far as the member conveys the developer for replenishment to the development roll while the developer is stirred, and the member is preferably constructed of a rotation shaft, and a member which is formed in a coil shape centered at the rotation shaft.

Figure 4A:
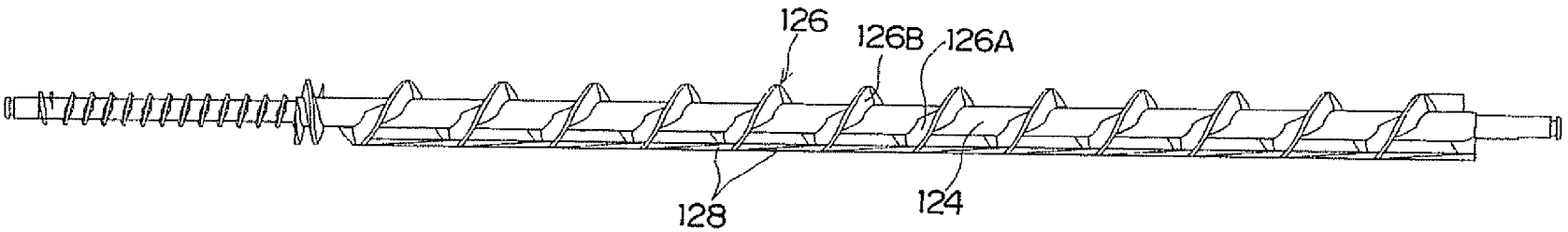
FIG. 4A is a perspective view showing an example of a stirring conveying apparatus in the present exemplary embodiment of the invention.
Figure 4B:
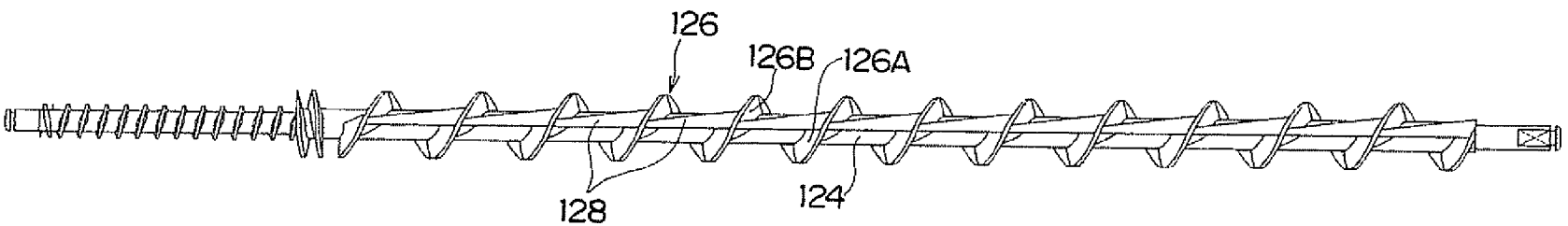
FIG. 4B is a perspective view showing an example of a stirring conveying apparatus in the present exemplary embodiment of the invention.

The stirring conveyance member will be explained using FIG. 4. FIG. 4 is a perspective view showing a construction of the stirring conveyance member in the present exemplary embodiment of the invention. The stirring conveyance member, as shown in FIGS. 4A and 4B, is constructed of a rotation shaft 124, and a blade 126 which is formed spirally around the rotation shaft 124, and bridges a blade member 128 with a conveyance surface 126A and a reverse-conveyance surface 126B of the blade 126, parallel with the rotation shaft 124 at an external periphery of this blade 126. That is, an external periphery of the blade 126 and an external surface of the blade member 128 are provided so that they become the same plane in the state where plural blade members 128 are continuous as one, parallel with the rotation shaft 124.

As the supply developer 150 used in the development apparatus 20, the already described supply developer of the present exemplary embodiment of the invention is used. In addition, as the initial developer used in the development apparatus 20, a two-component developer containing a carrier and a toner is used. The ratio (weight ratio) of mixing the toner and the carrier in the initial developer is preferably toner:carrier=1:100 to 30:100, more preferably in the range of 3:100 to 20:100. As the carrier in the initial developer, the same carrier as the already described supply carrier of the present exemplary embodiment of the invention is preferably used, and an unassociated carrier is also preferably used. On the other hand, as the toner used in the initial developer, the same toner as the already described toner in the developer for replenishment of the present exemplary embodiment of the invention is used.

EXAMPLES

The invention will be explained in more detailed below by way of Examples. However, the invention is not limited to the following Examples. In the following explanation, "part" means "part by weight".

(Preparation of Core Material Particle (A))

Into a Henschel mixer is placed 500 parts of a spherical magnetite particle powder having a volume average particle diameter of 0.40 μm, the powder is stirred, 5 parts of a titanate coupling agent is added, a temperature is raised to about 100° C., and the materials are mixed and stirred for 30 minutes, whereby, a spherical magnetite particle covered with the titanate-based coupling agent is obtained.

Then, into a 1 L four-neck flask are placed 55 parts of phenol, 70 parts of 35% formalin, 500 parts of the spherical magnetite particle obtained above, 18 parts of aqueous ammonia, and 55 parts of water, and the materials are stirred and mixed. Then, a temperature is raised to 85° C. for 50 minutes while the mixture is stirred, followed by allowing the mixture to undergo a reaction at the same temperature for 3 hours. Thereafter, the reaction solution is cooled to 25° C., 500 ml of water is added thereto, the supernatant is removed, and the precipitate is washed with water and dried to obtain a spherical core material particle (A) having a volume average particle diameter of 29.3 μm.

(Preparation of Core Material Particle (B))

Into a Henschel mixer is placed 500 parts of a spherical magnetite particle powder having a volume average particle diameter of 0.60 μm, the powder is stirred, 10 parts of a titanate coupling agent is added, a temperature is raised to about 100° C., and the materials are mixed and stirred for 30 minutes, whereby, a spherical magnetite particle covered with a titanate-based coupling agent is obtained.

Then, into a 1 L four-neck flask are placed 55 parts of phenol, 70 parts of formalin, 500 parts of the spherical magnetite particle obtained above, 18 parts of aqueous ammonia, and 55 parts of water, and the materials are stirred and mixed. Then, a temperature is raised to 85° C. for 70 minutes while the mixture is stirred, followed by allowing the mixture to undergo a reaction at the same temperature for 3 hours. Thereafter, the reaction solution is cooled to 25° C., 500 ml of water is added thereto, the supernatant is removed, and the precipitate is washed with water, and dried to obtain a spherical core material particle (B) having a volume average particle diameter of 65 μm.

(Preparation of Core Material Particle (C))

Into a Henschel mixer is placed 250 parts of a spherical magnetite particle powder having a volume average particle diameter of 0.60 μm, the powder is stirred, 5 parts of a titanate coupling agent is added, a temperature is raised to about 100° C., and the materials are mixed and stirred for 30 minutes, whereby, a spherical magnetite particle "a" covered with a titanate-based coupling agent is obtained. In addition, into another Henschel mixer is placed 250 g of a spherical magnetite particle powder having a volume average particle diameter of 0.40 μm. After stirring, 15 parts of a titanate coupling agent is added, a temperature is raised to about 100° C., and the materials are mixed and stirred for 30 minutes, whereby, a magnetite particle "b" treated with a titanate-based coupling agent is obtained.

Then, into a 1 L four-neck flask are placed 55 parts of phenol, 70 parts of formalin, 250 parts of the lipophilization-treated spherical magnetite particle "a", 250 parts of a magnetite particle "b", 18 parts of aqueous ammonia, and 55 parts of water and mixed with stirring. Then, a temperature is raised to 90° C. for 70 minutes while the mixture is stirred, followed by a reaction at the same temperature for 3 hours. Thereafter, the reaction solution is cooled to 25° C., 500 ml of water is added thereto, the supernatant is removed, and the precipitate is washed with water and dried to obtain a spherical core material particle (C) having the volume average particle diameter of 67 μm.

(Preparation of Raw Material Solution for Forming Covering Layer)

The following components are stirred/dispersed with a stirrer for 60 minutes to prepare a solution for forming a resin layer (1).

Toluene: 85 parts

Styrene-methacrylate copolymer (component ratio 30:70):15 parts

Carbon black (trade name: R330, manufactured by Cabot Corporation):1.8 parts

The following components are stirred/dispersed with a stirrer for 60 minutes to prepare a solution for forming a resin layer (2).

Toluene: 85 parts

Styrene-methacrylate copolymer (component ratio 30:70):15 parts

Carbon black (trade name: R330, manufactured by Cabot Corporation):3.0 parts

Manufacturing of Carrier A for Initial Developer (Manufacturing of Carrier A)

Into a desktop kneader (trade name: PNV-1H, manufactured by Irie Shokai Co., Ltd.) equipped with a vacuum degassing device are placed 100 parts of a solution for forming a resin layer (1) and 500 parts of a core material particle (A), the mixture is stirred for 10 minutes at a blade rotation speed of 50 rpm while a temperature is maintained at 60° C., a pressure is reduced to distill off toluene, this is cooled, and classification is carried out using a 75 μm sieve to obtain a carrier (A). The average particle diameter is 37 μm, and the shape factor is 104.

(Manufacturing of Carrier 1)

Into a desktop kneader (trade name: PNV-1H, manufactured by Irie Shokai Co., Ltd.) equipped with a vacuum degassing device are placed 100 parts of a solution for forming a resin layer (1) and 500 parts of a core material particle (A), the mixture is stirred for 10 minutes at a blade rotation speed of 15 rpm while a temperature is maintained at 60° C., a pressure is reduced to distill off toluene, this is cooled, and classification is carried out using a 75 μm sieve to obtain a carrier (1). When the resulting carrier (1) is observed with a scanning electron microscope, the ratio of an associated particle via the resin layer of the carrier particle ($N2/(N1+N2)\times100$) in the observation field is 70% by number. In addition, the average particle diameter is obtained by sampling 100 carrier particles by the already described method (which is also the same for the following carriers). The average particle diameter is 65 μm, and the shape factor is 120.

(Manufacturing of Carrier 2)

Into a desktop kneader (trade name: PNV-1H, manufactured by Irie Shokai Co., Ltd.) equipped with a vacuum degassing device are placed 100 parts of a solution for forming a resin layer (1) and 500 parts of a core material particle (A), the mixture is stirred for 10 minutes at a blade rotation speed of 10 rpm while a temperature is maintained at 60° C., a pressure is reduced to distill off toluene, this is cooled, and classification is carried out using a 180 μm sieve to obtain a carrier (2). When the resulting carrier (2) is observed with a scanning electron microscope, the ratio of an associated particle ($N2/(N1+N2)\times100$) is 75% by number. In addition, the average particle diameter is 153 μm, and the shape factor is 112.

(Manufacturing of Carrier 3)

Into a desktop kneader (trade name: PNV-1H, manufactured by Irie Shokai Co., Ltd.) equipped with a vacuum degassing device are placed 100 parts of a solution for forming a resin layer (2) and 500 parts of a core material particle (A), the mixture is stirred for 10 minutes at a blade rotation speed of 10 rpm while a temperature is maintained at 60° C., a pressure is reduced to distill off toluene, this is cooled, and classification is carried out using a 180 μm sieve to obtain a carrier (3). When the resulting carrier (3) is observed with a scanning electron microscope, the ratio of an associated particle ($N2/(N1+N2)\times100$) is 80% by number. The average particle diameter is 156 μm, and the shape factor is 170.

(Manufacturing of Carrier 4)

Into a desktop kneader (trade name: PNV-1H, manufactured by Irie Shokai Co., Ltd.) equipped with a vacuum degassing device are placed 100 parts of a solution for forming a resin layer (2) and 500 parts of a core material particle (A), the mixture is stirred for 10 minutes at a blade rotation speed of 10 rpm while a temperature is maintained at 60° C., a pressure is reduced to distill off toluene, this is cooled, and classification is carried out using a 355 μm sieve, and the particle obtained by classification is passed through a 250 μm sieve to obtain a net-like carrier (4). When the resulting carrier (4) is observed with a scanning electron microscope, the ratio of an associated particle (N2/(N1+N2)×100) is 70% by number. In addition, the average particle diameter is 285 μm, and the shape factor is 130.

(Manufacturing of Carrier 5)

Into a desktop kneader (trade name: PNV-1H, manufactured by Irie Shokai Co., Ltd.) equipped with a vacuum degassing device are placed 100 parts of a solution for forming a resin layer (1) and 500 parts of a core material particle (B), the mixture is stirred for 10 minutes at a blade rotation speed of 25 rpm while a temperature is maintained at 60° C., a pressure is reduced to distill off toluene, this is cooled, and classification is carried out using a 75 μm sieve to obtain a carrier (5). When the resulting carrier (5) is observed with a scanning electron microscope, it is confirmed that the carrier particle in the observation field is a single particle. In addition, the average particle diameter is 67 μm, and the shape factor is 104.

(Manufacturing of Carrier 6)

Into a desktop kneader (trade name: PNV-1H, manufactured by Irie Shokai Co., Ltd.) equipped with a vacuum degassing device are placed 100 parts of a solution for forming a resin layer (1) and 500 parts of a core material particle (C), the mixture is stirred for 10 minutes at a blade rotation speed of 25 rpm while a temperature is maintained at 60° C., a pressure is reduced to distill off toluene, this is cooled, and classification is carried out using a 75 μm sieve to obtain a carrier (6). When the resulting carrier (6) is observed with a scanning electron microscope, it is confirmed that the carrier particle in the observation field is a single particle. In addition, the average particle diameter is 65 μm, and the shape factor is 113.

(Manufacturing of Carrier 7)

Into a desktop kneader (trade name: PNV-1H, manufactured by Irie Shokai Co., Ltd.) equipped with a vacuum degassing device are placed 100 parts of a solution for forming a resin layer (2) and 500 parts of a core material particle (A), the mixture is stirred for 10 minutes at a blade rotation speed of 25 rpm while a temperature is maintained at 60° C., a pressure is reduced to distill off toluene, this is cooled, and classification is carried out using a 53 μm sieve to obtain a carrier (7). When the carrier is observed with a scanning electron microscope, the ratio of an associated particle (N2/(N1+N2)×100) is 25% by number. In addition, the average particle diameter is 43.5 μm, and the shape factor is 117.

(Manufacturing of Carrier 8)

Into a desktop kneader (trade name: PNV-1H, manufactured by Irie Shokai Co., Ltd.) equipped with a vacuum degassing device are placed 100 parts of a solution for forming a resin layer (2) and 500 parts of a silane coupling agent-treated core material particle (A), the mixture is stirred for 10 minutes at a blade rotation speed of 10 rpm while a temperature is maintained at 60° C., a pressure is reduced to distill off toluene, this is cooled, and classification is carried out using a 355 μm sieve, and the particle obtained by classification is passed through a 300 μm sieve to obtain a net-like carrier (8). When the resulting carrier (8) is observed with a scanning electron microscope, the ratio of an associated particle (N2/(N1+N2)×100) is 95% by number. In addition, the average particle diameter is 320 μm, and the shape factor is 150.

(Manufacturing of Toner A)

A toner A having the volume average particle diameter (Dv) of 5.6 μm, and a value obtained by dividing the volume average particle diameter (Dv) by the number average particle diameter (Dn) of 1.20 is prepared.

(Manufacturing of Toner B)

A toner B having the volume average particle diameter (Dv) of 7.5 μm, and a value obtained by dividing the volume average particle diameter (Dv) by the number average particle diameter (Dn) of 1.24 is prepared.

(Manufacturing of Toner C)

A toner C having the volume average particle diameter (Dv) of 5.8 μm, and a value obtained by dividing the volume average particle diameter (Dv) by the number average particle diameter (Dn) of 1.3 is prepared.

Examples 1 to 8, Comparative Examples 1 to 2

As the image forming apparatus, a modified machine of Docu Centre Color 400 (DCC400) manufactured by Fuji Xerox Co., Ltd. equipped with a developer cartridge for replenishment is used. A toner and a carrier A as a combination shown in Table 1 are placed into a V blender at the ratio of 20 parts of the toner and 200 parts of the carrier, the materials are mixed, and this as an initial developer is accommodated into the modified machine of DCC400. On the other hand, the same kind of the toner and a carrier shown in Table 1 are placed into a V blender at the ratio of 300 parts of the toner and 30 parts of the carrier, the materials are mixed, and this as a developer for replenishment is accommodated into the modified machine of the developer cartridge for replenishment for DCC400.

(Concentration Fluctuation)

Then, 5000 sheets of 2 cm×2 cm plain image are printed while the developer for replenishment is replenished, so that the toner concentration of the developer in the development apparatus maintains an initial value. Thereupon, the concentration of the plain image is measured with a reflection concentration meter (trade name: X-rite 404, manufactured by X-rite) per 500 sheets of image. From the concentration of the measured plain image, the maximum concentration value and the minimum concentration value are obtained, and concentration fluctuation is evaluated based on the following criteria. Results are shown in Table 1.

A: A difference between the maximum concentration value and the minimum concentration value is less than 0.3.

B: A difference between the maximum concentration value and the minimum concentration value is 0.3 or more and less than 0.5.

C: A difference between the maximum concentration value and the minimum concentration value is 0.5 or more and less than 0.8.

D: A difference between the maximum concentration value and the minimum concentration value is 0.8 or more.

(Roughness of Image Surface)

Regarding each of plain images obtained in the evaluation of concentration fluctuation, roughness of an image surface is evaluated visually and with a loupe based on the following criteria. Results are shown in Table 1.

A: No roughness is observed at a visual level and, even when observed with a loupe, roughness is not observed.

B: It seems that there is no roughness at a visual level, but when observed with a loupe, roughness is partially observed.

C: Roughness is partially observed at a visual level.

D: Roughness is clearly observed at a visual level.

TABLE 1

| | | Carrier | | | | Evaluation | |
|---|---|---|---|---|---|---|---|
| | Toner Kind | Kind | Average particle diameter | Shape factor | N2/(N1 + N2) × 100 | Concentration fluctuation | Roughness of image surface |
| Example 1 | Toner A | Carrier 1 | 65 μm | 120 | 70% by number | B | A |
| Example 2 | Toner A | Carrier 2 | 153 μm | 112 | 75% by number | A | A |
| Example 3 | Toner A | Carrier 3 | 156 μm | 170 | 80% by number | A | A |
| Example 4 | Toner A | Carrier 4 | 285 μm | 130 | 70% by number | A | B |
| Example 5 | Toner A | Carrier 7 | 43.5 μm | 117 | 25% by number | C | A |
| Example 6 | Toner A | Carrier 8 | 320 μm | 150 | 95% by number | B | C |
| Example 7 | Toner B | Carrier 1 | 65 μm | 120 | 70% by number | B | B |
| Example 8 | Toner C | Carrier 1 | 65 μm | 120 | 70% by number | B | C |
| Comparative Example 1 | Toner A | Carrier 5 | 67 μm | 104 | — | C | D |
| Comparative Example 2 | Toner A | Carrier 6 | 65 μm | 113 | — | C | D |

What is claimed is:

1. A carrier used in a trickle development system of an electrophotographic apparatus, wherein the system develops a latent image with a developer including the carrier, and the developer is supplied to the system to replace a deteriorated carrier that was previously supplied to the system, the carrier comprising:

single particles and bonding particles, each of the single particles having:

a core material; and a resin layer covering the core material;

wherein each of the bonding particles is constituted by a plurality of single particles that are bonded to each other via the resin layer, the carrier comprises a predetermined number of the single particles that do not constitute the bonding particles, a content ratio of the bonding particles to the single particles that do not constitute the bonding particles in the carrier, when expressed by (N2/(N1+N2)×100) in which the particle number of the single particles that do not constitute the bonding particles is designated as N1 and the particle number of the bonding particles is designated as N2, is from about 30% by number to about 95% by number, and a resin of the resin layer is a member selected from the group consisting of polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymer, styrene-acrylic acid copolymer, styrene methacrylate copolymer, fluorine resin, polyester, polycarbonate, phenol resin, and epoxy resin.

2. The carrier according to claim 1, wherein the average particle diameter of the carrier is from about 50 μm to about 300 μm.

3. The carrier according to claim 1, wherein the number of the single particles that constitute the bonding particle is from 2 to 15.

4. The carrier according to claim 1, wherein the shape factor of the carrier is about 110 to about 230.

5. The carrier according to claim 1, wherein the volume average particle diameter of the core material is from about 10 μm to about 150 μm.

6. The carrier according to claim 1, wherein the amount of the resin layer covering the core material is from about 0.1 parts by weight to about 10 parts by weight based on 100 parts by weight of the core material.

7. The carrier according to claim 1, wherein the covering rate of the core material surface with the resin layer is about 95% or more.

8. A developer for replenishment comprising a toner and the carrier according to claim 1.

9. The developer for replenishment according to claim 8, wherein an amount of the toner is from 70 parts by weight to 95 parts by weight based on 100 parts by weight of the carrier.

10. A carrier used in a trickle development system of an electrophotographic apparatus, wherein the system develops a latent image with a developer including the carrier, and the developer is supplied to the system to replace a deteriorated carrier that was previously supplied to the system, the carrier comprising:

single particles and bonding particles, each of the single particles having:

a core material, and a resin layer covering the core material, wherein each of the bonding particles is constituted by a plurality of single particles that are bonded to each other via the resin layer, and the content ratio of the bonding particles to the single particles that do not constitute the bonding particles in the carrier, when expressed by (N2/(N1+N2)×100) in which the particle number of the single particles that do not constitute the bonding particles is designated as N1 and the particle number of the bonding particles is designated as N2, is from about 50% by number to about 90% by number.

11. A carrier comprising:

single particles and bonding particles, each of the single particles having:

a core material, and a resin layer covering the core material, wherein each of the bonding particles is constituted by a plurality of single particles that are bonded to each other via the resin layer, and the carrier satisfies the following formula:

$$95 \geq (N2/(N1+N2)\times 100) \geq 30$$

wherein, the formula N1 represents a particle number of the single particles that do not constitute the bonding particles and N2 represents a particle number of the bonding particles.

12. A developer for replenishment comprising a toner and the carrier according to claim 11.

13. The developer for replenishment according to claim 12, wherein an amount of the toner is from 70 parts by weight to 95 parts by weight based on 100 parts by weight of the carrier.

* * * * *